US009150979B1

(12) United States Patent
Mitra et al.

(10) Patent No.: US 9,150,979 B1
(45) Date of Patent: Oct. 6, 2015

(54) APPARATUS FOR FOCUSED ELECTRIC-FIELD IMPRINTING FOR MICRON AND SUB-MICRON PATTERNS ON WAVY OR PLANAR SURFACES

(71) Applicant: Actus Potentia, Inc., Ames, IA (US)

(72) Inventors: Ambar K. Mitra, Ames, IA (US); Ashraf F. Bastawros, Ames, IA (US); Abhijit Chandra, Ames, IA (US); Charles A. Lamaire, Apple Valley, MN (US)

(73) Assignee: Actus Potentia, Inc., Ames, IA (US)

( * ) Notice: Subject to any disclaimer, the term of this patent is extended or adjusted under 35 U.S.C. 154(b) by 0 days.

(21) Appl. No.: 14/145,697

(22) Filed: Dec. 31, 2013

Related U.S. Application Data

(62) Division of application No. 13/210,372, filed on Aug. 16, 2011, now Pat. No. 8,617,378, which is a division of application No. 11/811,288, filed on Jun. 7, 2007, now Pat. No. 7,998,323.

(60) Provisional application No. 60/804,163, filed on Jun. 7, 2006.

(51) Int. Cl.

| | |
|---|---|
| ***C25D 5/02*** | (2006.01) |
| ***C25D 17/00*** | (2006.01) |
| ***C25F 3/02*** | (2006.01) |

(52) U.S. Cl.
CPC *C25D 17/00* (2013.01); *C25D 5/02* (2013.01); *C25F 3/02* (2013.01)

(58) Field of Classification Search
CPC ..... C25D 17/00; C25D 5/02
USPC ..... 205/136
See application file for complete search history.

(56) References Cited

U.S. PATENT DOCUMENTS

| | | | | |
|---|---|---|---|---|
| 7,566,385 | B2 * | 7/2009 | Mazur et al. | 204/224 M |
| 7,691,250 | B2 * | 4/2010 | Mazur et al. | 205/668 |

* cited by examiner

*Primary Examiner* — Bryan D. Ripa
(74) *Attorney, Agent, or Firm* — Charles A. Lemaire; Lemaire Patent Law Firm, P.L.L.C.

(57) ABSTRACT

Focused Electric Field Imprinting (FEFI) provides a focused electric field to guide an unplating operation and/or a plating operation to form very fine-pitched metal patterns on a substrate. The process is a variation of the electrochemical unplating process, wherein the process is modified for imprinting range of patterns of around 2000 microns to 20 microns or less in width, and from about 0.1 microns or less to 10 microns or more in depth. Some embodiments curve a proton-exchange membrane whose shape is varied using suction on a backing fluid through a support mask. Other embodiments use a curved electrode. Mask-membrane interaction parameters and process settings vary the feature size, which can generate sub-100-nm features. The feature-generation process is parallelized, and a stepped sequence of such FEFI operations, can generate sub-100-nm lines with sub-100-nm spacing. The described FEFI process is implemented on copper substrate, and also works well on other conductors.

20 Claims, 10 Drawing Sheets

Device for FEFI parallel processing.

APPARATUS FOR FOCUSED ELECTRIC-FIELD IMPRINTING FOR MICRON AND SUB-MICRON PATTERNS ON WAVY OR PLANAR SURFACES

CROSS-REFERENCE TO RELATED APPLICATIONS

This application is a divisional of U.S. patent application Ser. No. 13/210,372, filed on Aug. 16, 2011, titled "METHOD FOR FOCUSED ELECTRIC-FIELD IMPRINTING FOR MICRON AND SUB-MICRON PATTERNS ON WAVY OR PLANAR SURFACES" which issued as U.S. Pat. No. 8,617,378 on Dec. 31, 2013), which is a divisional of U.S. patent application Ser. No. 11/811,288, filed on Jun. 7, 2007, titled "METHOD AND APPARATUS FOR FOCUSED ELECTRIC-FIELD IMPRINTING FOR MICRON AND SUB-MICRON PATTERNS ON WAVY OR PLANAR SURFACES" (which issued as U.S. Pat. No. 7,998,323 on Aug. 16, 2011), which claimed benefit under 35 U.S.C. 119(e) of U.S. Provisional Patent Application No. 60/804,163, filed on Jun. 7, 2006, titled "METHOD AND APPARATUS FOR FOCUSED ELECTRIC-FIELD IMPRINTING FOR MICRON AND SUB-MICRON PATTERNS ON WAVY OR PLANAR SURFACES," each of which is incorporated herein by reference in its entirety for all purposes.

FIELD OF THE INVENTION

The invention relates to the field of semiconductor manufacturing, and more specifically, the invention describes a new technique for electrochemical unplating or plating/deposition of micro and nano-scale patterns. The invention describes a procedure that is a potential substitute for lithography.

BACKGROUND OF THE INVENTION

There exist today several innovative manufacturing technologies to meet the demand for the production of components with features in the range of a sub-micron to several hundred micrometers. They are classified into two basic groups (Rajurkar et al, 2006): (i) lithography based micro fabrication processes, which are capable of micro and sub-micrometer size features, and (ii) micro manufacturing processes, which are capable of micro and miniaturized part fabrications. Unfortunately, we are rapidly approaching the limit of traditional processing methods for functionalizing and processing inexpensive miniaturized devices. Clearly, a major challenge remains in the micro-manufacturing community to develop flexible, robust and large-scale fabrication methods that are economical and also environmentally friendly.

Traditionally, the lithography based processes employ either material addition (e.g., Physical Vapor Deposition "PVD," Chemical Vapor Deposition "CVD," and electrodeposition) or material subtraction (e.g., UV and e-beam lithography) to produce micron and submicron scale surface patterning. However, such processes are naturally limited by macro-scale phenomenon such as diffusion or thermal gradients. Any patterning scheme utilizing deposition methods must create and maintain a tight gradient (in the nanometer range) in driving force to control deposition and transport rates. Although subtraction processes such as electron or ion beam writing possess very high resolution capabilities for local patterning, they are sequential and cumbersome (due to macro-scale positioning requirements) with limitations in the materials they can modify and strict requirements of surface planarity. Thus, direct extension of lithographic based fabrication facility, with its attendant high cost of ownership (COO) and the required capital outlay of upwards of $3 billion are somewhat impractical for miniaturized components for targeting inexpensive and rapid throughput.

For example, the MicroStepper described by Miller et al. (2000) can achieve sub-100-nm patterning, but the equipment is expensive and requires planarized surfaces with roughness of the order of 0.1 times the wavelength of the ultraviolet light.

Non-lithographic based processes can also be classified as additive and subtractive processes (see Rajurkar et al., 2006 and the references therein for an exhaustive list of processes). Out of this list, we focus our attention on mechanical micromachining vs. electro-physical and chemical processes (ECP). In mechanical micromachining, a direct contact with the work piece is established, with good geometric correlation between the tool path and the work piece. While they possess high material removal rate, these methods, however, are not suitable for very hard or very fragile, e.g., low dielectric porous materials. In addition, they induce significant level of residual stresses, and possess additional limitations on dimensional tolerances and minimum gage requirements (Liu et al, 2004). On the other hand, ECP offer distinct advantages by not contacting the work-piece, especially in electro-discharge machining (EDM) and electrochemical machining (ECM). The ECP eliminates the drawback due to elastic spring back and the minimum gage requirement to sustain the cutting forces. In addition, they are quite economical for small batch productions (IWF, 2002). The ECP processes have been successfully employed in aerospace, automobile, and other industries for shaping, cutting, debarring and finishing. These processes provide solutions for manufacturing small and very precise components and micro-systems for the watch industry, micro-optics (telecommunications), medicine (processing biocompatible materials, medical implants) and chemical industry (micro-reactors).

ECM process can provide excellent performance for large and contoured surfaces. It also provides low material waste and very little tool wear. Complex shapes ranging from hard to machine titanium and wasp alloys aircraft engine casings (McGeough, 1974), to miniaturized LIGA processes are common utilization of ECM (Friedrich et al., 1997; Dunkel et al., 1998, Craston et al., 1988; Husser et al., 1989). While the EC process has found major applications in IC fabrications such as in Damascene Cu Plating (Andricacos, 1999) and in electrochemical mechanical planarization of wafers (Steigerwald et al., 1997; Huo et al., 2004), most ECM processes, however, are not environmentally benign. They also give rise to thermal and environmental concerns. The finished surface comes in contact with corrosive chemicals, which may accelerate corrosion and necessitate post-ECM cleaning of the finished surface (Wilson, 1971). Maintaining an ECM tool over a long period of time has also proved difficult.

The electrochemical process described by Mazur et al. (2005) is environmentally benign. However, it is only meant for polishing or planarization, and cannot imprint a specified pattern on a surface.

The traditional lithography or other contact printing processes also require extremely tight tolerances in surface roughness and planarization. This makes surface preparation for such processes quite expensive, often requiring chemical mechanical planarization "CMP."

Thus, capability for printing on wavy surfaces is also required for flexible IC devices, where performing CMP is very difficult. Therefore, there is a need in the industry for a device that produces sub-100-nm patterns through a non-contact process. The conventional available devices that can produce such patterns are expensive, and also typically require polished or planarized surfaces.

SUMMARY OF THE INVENTION

The disclosed invention provides a Focused Electric Field Imprinting (FEFI) process. It is a variation of the electrochemical unplating process wherein the process is adapted for imprinting range of patterns of around 20-2000 microns in width and 0.1-10 microns in depth. A suitably curved proton exchange membrane and/or curved electrode are key elements of some embodiments of the process. By altering mask-membrane interaction parameters and process settings, one can significantly reduce the feature size and possibly generate sub-100-nm features. By using a mesh or mask as the electrode behind the membrane in the electrochemical cell, the feature generation process is parallelized. Using a sequence of such FEFI steps, and proper mask alignment, one can also generate sub-100-nm lines with sub-100-nm spacing. The described FEFI process has been implemented on copper substrate, but the process works equally well on any electrical conductor. FEFI is provided as a cost-advantaged alternative to lithographic techniques.

In this patent application we specifically focus on creating patterns on bulk copper substrate or on a thin layer of copper that is deposited on a substrate. The disclosed process is also applicable to any electrically conducting surfaces. The described FEFI technique of the present invention can imprint on wavy surfaces. Thus, in microelectronic processing, it can potentially eliminate the CMP process step. In other industries such as heat exchangers and injection molding dies, FEFI process can generate three dimensional micron and submicron size features on wavy surfaces. FEFI tools of the present invention are also expected to be a factor of 10 to 100 less expensive.

The device described in this patent application utilizes a non-contact electrochemical process that can produce specified patterns of around few microns in size. With appropriate consumables and process settings, production of sub-100-nm patterns is possible. Furthermore, this device can produce the above patterns on wavy surfaces, thereby relaxing the highly planarized surface requirement (Mazur et al., 2005).

Comparison with Other Similar Inventions

Currently, Deep Ultraviolet (DUV) Steppers are used for Lithography. The cost of a manual DUV Stepper is of the order of $250,000, and an automatic DUV Stepper may cost up to $10,000,000. The estimated cost of the device described in this patent application is $10,000 for a manual version and $100,000 for an automatic version.

A DUV Stepper needs a planarized surface (Mazur et al., 2005) where, in some embodiments, the surface roughness may not exceed 0.1 times the wavelength of the ultraviolet light. The device described in this patent application relaxes the planarization requirement by a factor of 100 to roughly 1000.

The device of the present invention can produce circular and linear imprints or a combination of them to generate two-dimensional patterns on the substrate. A modification of the basic set-up can produce imprints that are either an array of circles or a number of parallel lines with different edge profile. With appropriate masks, it can produce imprints in any arbitrary closed or connected shapes. The number of circular imprints or the number of line imprints is easy to control and scalable for large-area arrays or for continuous on-line operation.

DETAILED DESCRIPTION OF THE INVENTION

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized, and that structural, sequential, and temporal changes may be made without departing from the scope of the present invention.

The leading digit(s) of reference numbers appearing in the Figures generally corresponds to the Figure number in which that component is first introduced, such that the same reference number is used throughout to refer to an identical component that appears in multiple Figures. Trailing letters appending reference numbers generally refer to variations of embodiments regarding a component or process. Signals and connections may be referred to by the same reference number or label, and the actual meaning will be clear from its use in the context of the description.

As used herein "unplate" or "unplating" (though not in the present disclosure, this was sometimes informally called "etching" in U.S. Provisional Patent Application No. 60/804,163 filed by the inventors of the present invention) means a process of electrolytically removing material (such as one or more metals) from the substrate of interest. As used herein "plate" or "plating" means a process of electrolytically adding material (such as one or more metals) to the substrate of interest. Plating and unplating may use water, or acids or salts in a suitable solvent such as water. As used herein "wet etching" means a process of using strong acid to remove material from the unprotected parts of a metal surface to create a pattern by removing metal from the substrate of interest (and may or may not also include applying an electrical current). As used herein "dry etching" means a process such as bombarding a metal with ions (such as reactive-ion etching ("RIE") or deep reactive-ion etching ("DRIE")) to remove material from the unprotected parts of a metal surface to create a pattern by removing metal from the substrate of interest. As used herein "etching" includes wet etching and/or dry etching.

The Devices

Figure 1A:
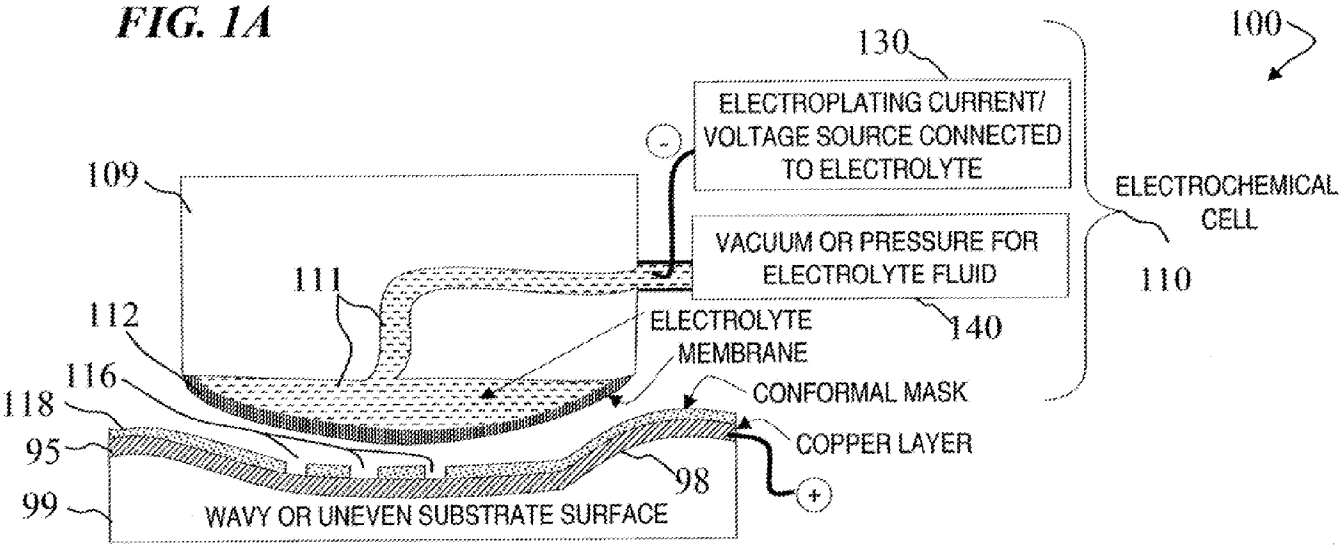
FIG. 1A is a side cross-section view of a system 100 that operates under principle of operation A—an electrochemical cell conforming to wavy surface.

FIG. 1A is a side cross-section view of a system 100 that operates under principle of operation A—an electrochemical cell conforming to wavy surface. In FIG. 1A, one general principle of operation of the device 110 is shown in a system 100. In this principle of operation, the membrane forms a flexible and/or compliant surface (typically convex in shape, but some embodiments can include concave shapes or a variety of different shapes, as needed) having a uniform electric field. In other embodiments, the electric field is non-uniform to achieve the unplating desired or inversely the deposition if needed. The electrochemical cell device 110 has an electrolyte-filled membrane 112 that can be deformed to suit the patterning needs on a wavy surface (please note that this membrane surface need not exactly conform to the wavy surface). Hence, the substrate 99 and the patterned surface 98 are shielded from direct contact with the electrolyte 111 by membrane 112 that contains electrolyte 111. This will eliminate the need for post-process cleaning. The electrochemical cell 110 is located above the substrate 99 that may have a flat, uneven or even wavy surface 98, and is immersed in a fluid such as de-ionized (DI) water. In some embodiments, cell 110 has a membrane 112 that can be formed to a conforming convex and/or concave surface by applying controlled pressure to an electrolyte 111 that is contained and held inside cell 110 by membrane 112. In some embodiments, a thin and/or very flexible membrane 112 is used, in order that the membrane 112 closely conforms to all portions of the wavy surface of substrate 99. Thus, in some embodiments, the present invention provides a membrane 112 that is sufficiently thin and/or flexible so as to conform to a majority (i.e., about 50% or more) of the surface of substrate 99 opposite the membrane 112. In various other embodiments, membrane 112 is sufficiently thin and/or flexible so as to conform to about 60% or more, about 70% or more, about 80% or more, or about 90% or more, respectively, of the surface of substrate 99 opposite the membrane 112, In some other embodiments, a thicker and/or stiffer membrane 112 is used, in order to provide a slightly-conforming surface of membrane 112, which contacts only the highest points of conductor 99. This provides a way of planarizing a copper layer 95 on substrate 99 that is a non-abrasive-contact alternative to chemical-mechanical polishing (CMP). Thus, in some embodiments, the present invention provides a membrane 112 that is sufficiently thick and/or stiff so as to conform to a minority (i.e., less than about 50%) of the surface of substrate 99 opposite the membrane 112. In various other embodiments, membrane 112 is sufficiently thick and/or stiff so as to conform to about 40% or less, about 30% or less, about 20% or less, or about 10% or less, respectively, of the surface of substrate 99 opposite the membrane 112. (Mazur et al. 2005 uses a conventional device but for planarization only. The present invention for patterning and for conforming to wavy or uneven surfaces distinguishes from that.) In some embodiments, the micro- or nano-roughness of copper layer 95 is smoothed, while the larger scale waviness is maintained or not substantially disturbed. In contrast, conventional systems need to be planarized to achieve very small smoothness (e.g., smoothness to one-tenth the wavelength of UV light (i.e., 20 to 40 nanometers). The cell 110 need not move, and, in some embodiments, a thin layer of DI water remains between membrane 112 and copper layer 95 during the unplating (or the inverse of plating) operation. In other embodiments, a pattern 120 is to be imprinted on the wavy surface 98 of substrate 99, and so a photoresist-defined mask layer 118 having one or more openings 116 is deposited on the top wavy surface (that follows wavy surface 98) of the copper or other metal layer 95. Note that the unplating operation is not performed to the entire substrate 99, but only to those portions that are contacted by membrane 112. In some embodiments, de-ionized water is applied in and between openings 116 and membrane 112. In some embodiments, electrolyte 111 is a solution of a suitable chemical (such as a metal salt dissolved in water) that removes one or more metals that are unplated through holes 116 and from conductive surface 95 when the electric current forces ions of the metal(s) through membrane 112.

Figure 1B:
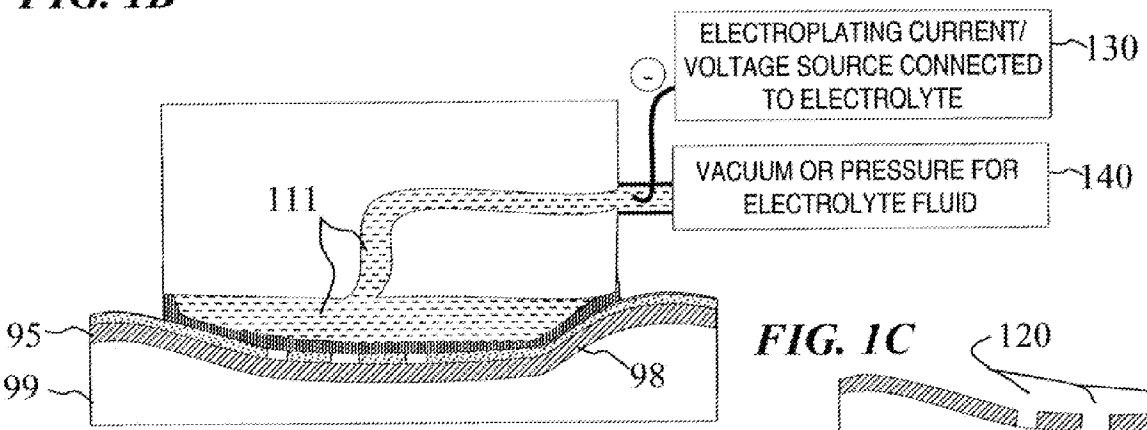
FIG. 1B is a side cross-section view of a system 100 when using principle of operation A—an electrochemical cell conforming to wavy surface to unplate or remove selected portions of a metal layer 95.

FIG. 1B is a side cross-section view of a system 100 when using principle of operation A—an electrochemical cell conforming to wavy surface to unplate or remove selected portions of a metal layer 95.

Figure 1C:
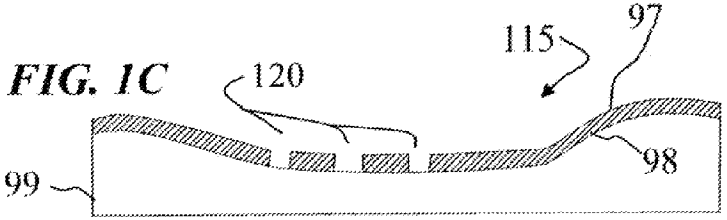
FIG. 1C is a side view of a substrate 99 and its resulting unplated wavy surface.

FIG. 1C is a side cross-section of the resulting unplated conductive pattern 98 (e.g., of copper, in some embodiments)

on the wavy surface of substrate 99. In the example embodiment shown, a pattern of holes, trenches or other openings 120 has now been unplated through the layer 95 (see FIG. 1B) to form conductive pattern 98 (which is the copper left after the unplating of the holes 120). The conductive pattern can leave wire traces, ground planes, or other patterns. In some embodiments, the pattern 120 includes structures in the surface that were previously lithographically defined by other processes (i.e., either prior lithography by other processes, or prior plating or unplating operations using the present invention). In some such embodiments, the surface has no photoresist mask 118 during the unplating, but rather just provides the compliant membrane to comply with the overall waviness of the surface. This is used when plating or unplating larger portions of a wavy or uneven substrate. In other embodiments, a photoresist pattern 118 is provided that limits and defines the areas that are unplated and removed to leave pattern 120.

Figure 1D:
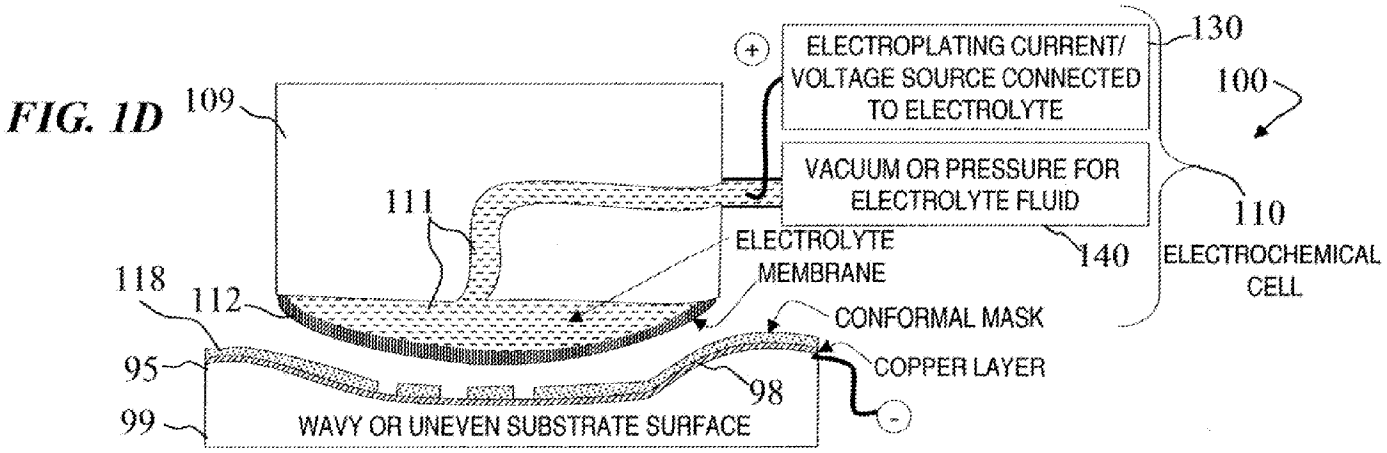
FIG. 1D is a side cross-section view of a system 100 that operates under principle of operation A—an electrochemical cell conforming to wavy surface.

FIG. 1D is a side cross-section view of a system 100 that operates under principle of operation A—an electrochemical cell conforming to wavy surface. In some embodiments, system 100 of FIG. 1D is identical to system 100 of FIG. 1A, except that the polarity of the voltage supply is reversed, in order to plate (add) metal to the conductive layer 95 on the substrate 99. In the embodiment shown, a pattern of raised areas will be plated (added) onto the openings 16 in mask layer 118. Note that the plating operation is not performed to the entire substrate 99, but only to those portions that are contacted by membrane 112. In some embodiments, de-ionized water is applied in and between openings 116 and membrane 112. In some embodiments, electrolyte 111 is a solution of a suitable chemical (such as a metal salt dissolved in water) that supplies one or more metals that are plated into holes 116 and onto conductive surface 95 when the electric current forces ions of the metal(s) through membrane 112.

Figure 1E:
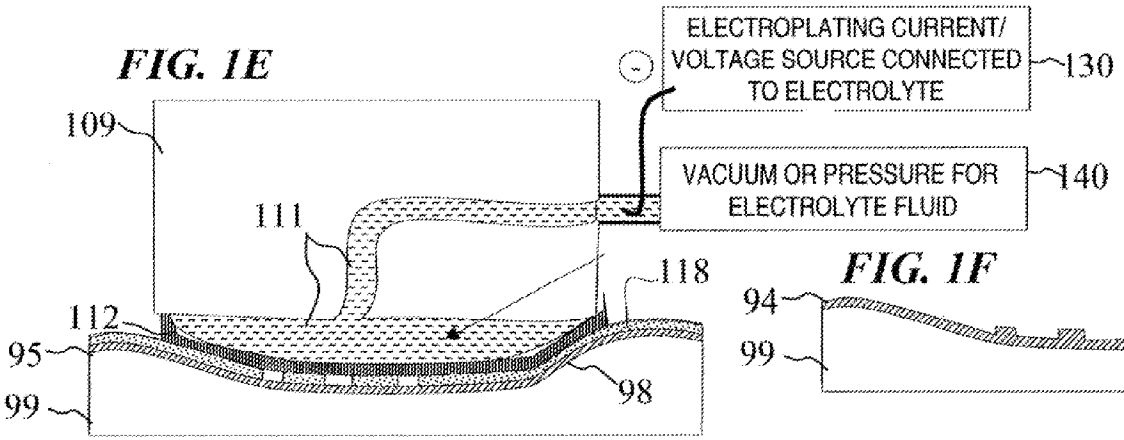
FIG. 1E is a side cross-section view of a system 100 when using principle of operation A—an electrochemical cell conforming to wavy surface to plate or add selected portions of a metal layer 95.

FIG. 1E is a side cross-section view of a system 100 when using principle of operation A—an electrochemical cell conforming to wavy surface to plate or add selected portions on top of a metal layer 95 through the openings in mask 118.

Figure 1F:
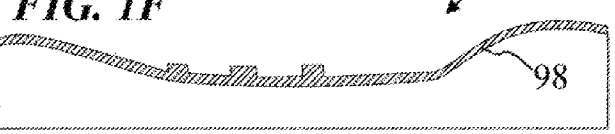
FIG. 1F is a side view of a substrate 99 and its resulting plated wavy surface.

FIG. 1F is a side view of a substrate 99 and its resulting plated layer 94 having raised areas of additional material (corresponding to the openings in mask 118, which has now been dissolved in a suitable solvent or otherwise removed) on the wavy surface of substrate 99. In some embodiments, the entire top surface is then slightly etched away (e.g., using an acid for a controlled amount of time, with the results shown in FIG. 1G), thus totally removing the thin background layer of metal (e.g., copper) but leaving the islands 93 of metal where the additional material had been plated during the operation shown in FIG. 1E.

Figure 1G:
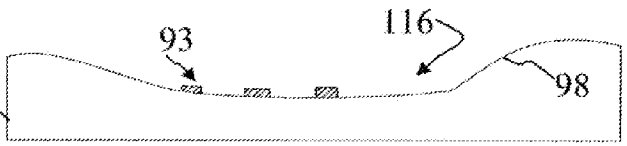
FIG. 1G is a side view of a substrate 99 and its resulting plated and unplated wavy surface.

FIG. 1G is a side view of a substrate 99 and its resulting plated and etched pattern of metal 93 on the wavy surface of substrate 99.

In other embodiments, the "mask" in the present invention is a topographical pattern that is behind the membrane (i.e., distal from the surface being unplated) or on a front surface of the membrane (i.e., proximal to the surface being unplated) in the electrolytic cell. In some such embodiments, the mask is formed on a surface of membrane 112, and made of a suitably flexible non-conductive and/or ion-blocking material (such as photoresist) that is applied to the membrane 112 and patterned (e.g., silk-screened onto the surface through a stencil, or applied as a photoresist and then patterned using conventional photolithography). In some embodiments, features on the mask are planar or are formed to assume a concave or convex shape, in order that the shape is used to further focus the electric field, depending on the direction of the Faradic current flow for unplating or deposition. Also, in some embodiments, the mask is not photo-resist based, but can be produced by other micro machining techniques such as fiber weaving, laser or other surface manipulation techniques, or by depositing through a stencil such as is done in silk-screening processes.

As an alternative to CMP where mechanical pressure or motion is required to assist the chemical action to remove the copper and where a planarized surface may be required in order to be able to CMP, some embodiments of the present invention use the conforming surface of membrane 112 to provide a well-defined and uniform electric field over openings 116 to remove by unplating (or add by plating) predictable and controllable amounts of copper. In some embodiments (e.g., device 110' of FIG. 2A), the back membrane support of the cell 110 is shaped (e.g., using an etched silicon wafer (e.g., etched to form the needed channels, trenches, and or holes through the silicon backing member that define the edges of the membrane's curved surface features) with an imprinted pattern of copper electrode or a weaved wire mesh; and, in some embodiments, membrane 112 is adhesively held (with adhesive 119) to this patterned support (e.g., etched silicon wafer)) to provide additional shaping definition to the conforming surface (convex or concave, depending on the pressure or vacuum differentially applied) of membrane 112 and depending of the process is for selective unplating (removal) or selective plating (deposition). The shapes of the mesh or mask behind the membrane 112, together with membrane curvature in the electrochemical cell 110 determine the shape of the imprinting (e.g., differential unplating or plating of the copper). When the cell 110 is a vertical cylinder with circular bottom cross-section, the imprinted pattern can be circular. When the cell is shaped like half of a circular cylinder oriented horizontally and the bottom cross-section is a rectangle, the imprinted pattern is a straight rectangle, whose width may be controlled by adjusting the membrane curvature (or suction pressure), the standoff distance and the strength of the electric field. In some embodiments, the copper-removal pattern is defined by mask 118, its local feature curvature and its openings 116, in addition to the shape of membrane 112.

Figure 2A:
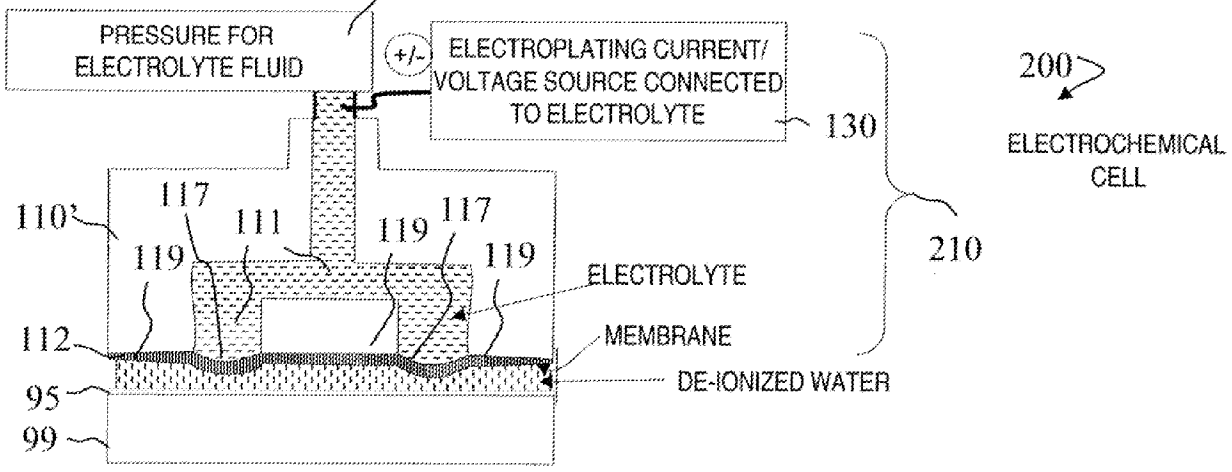
FIG. 2A is a side cross-section view of a device 110' of an embodiment that could define a convex surface 117 defined by higher pressure inside the cell's electrolyte than in the DI water, and which operates under Principle of operation A—an electrochemical cell conforming to flat or wavy surface.

FIG. 2A shows a device 110' of an embodiment that could define a convex surface 117 defined by higher pressure inside the cell's electrolyte than in the DI water.

Figure 2B:
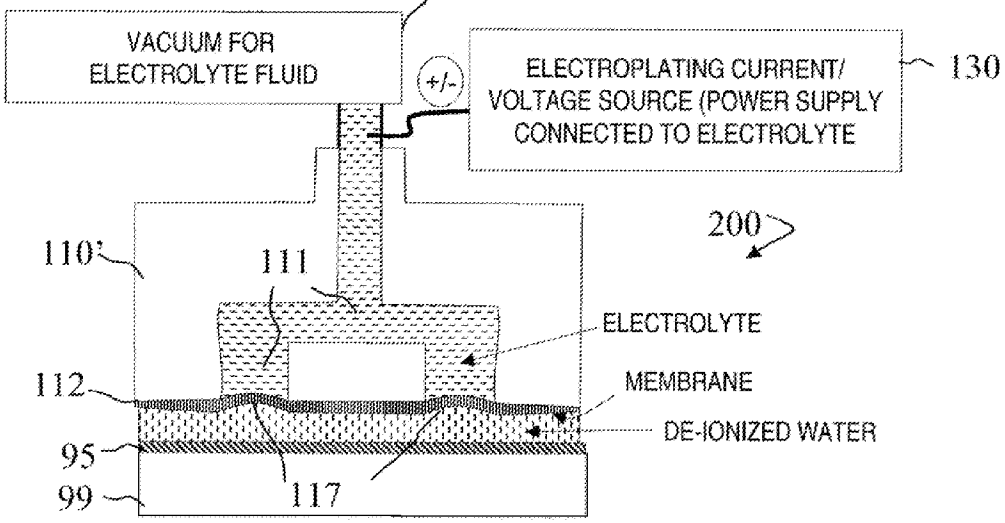
FIG. 2B is a side cross-section view of a system 200 that operates under Principle of operation B—focused-electric-field on flat or wavy surface.

FIG. 2B shows a device 110' of an embodiment that could define a concave surface defined by higher pressure inside the cell's electrolyte than in the DI water.

Figures 2C, 2D:
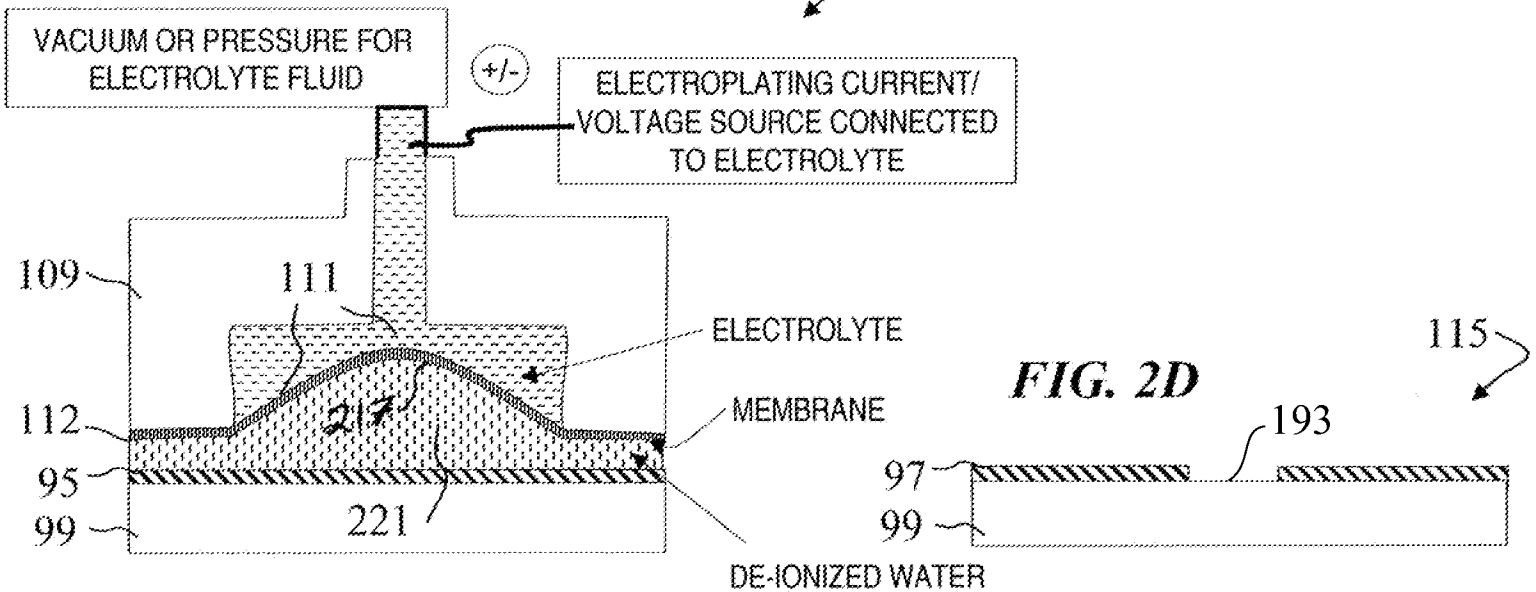
FIG. 2C is a side cross-section view of a system 200 of an embodiment that provides a concave surface 217 defined by lower pressure inside the cell's electrolyte than in the DI water.
FIG. 2D is a side cross-section view of a substrate 115 having a hole 193 formed using focussed-field system 200 of FIG. 2C.

FIG. 2C shows a device 210 that illustrates a Principle of operation B of the present invention—focused-electric-field on a flat or wavy surface. In this mode of operation, membrane 212 does not move to conform to the surface 98, but rather is held in a three-(3)-dimensional shape defined by the surface to which the membrane is mounted and the differential pressure on the membrane. As the need arises, however, the membrane and/or the substrate may be moved, relative to each other, to generate a variety of unplated and/or plated shapes. FIG. 2C is a side cross-section view of a system 200 of an embodiment that provides a concave surface 217 defined by lower pressure inside the cell's electrolyte than in the DI water. When operating in an unplating mode, system 200 removes metal (from layer 95 on substrate 99) selectively according to the focussed field. FIG. 2D is a side cross-section view of a substrate 115 having a hole 193 and a metal pattern 97 on a substrate 99, the hole 193 having been formed using focussed-field system 200 of FIG. 2C.

FIG. 2C shows an embodiment of a device 210 that could define a concave surface 217 defined by lower pressure inside the cell's electrolyte than in the DI water. In some embodiments, the shape and local curvature of the electrode on the back of the membrane defines the shape of the electric field on the front of the membrane, and thus defines the rates of copper removal or deposition. In some embodiments, the concave surface 217 defines an electric field that removes copper from hole 193 (see FIG. 2D) and leaves copper in pattern 97 (again, see FIG. 2D). In some embodiments (e.g., device 110' of FIG. 2A), the back membrane support of the cell 110 is shaped (e.g., using an etched silicon wafer with an imprinted pattern of copper electrode or a weaved wire mesh; and, in some embodiments, membrane 112 is adhesively held (with adhesive 119) to this patterned support) to provide additional shaping definition to the conforming surface (convex or concave, depending on the pressure or vacuum differentially applied) of membrane 112.

Figures 3A, 3B:
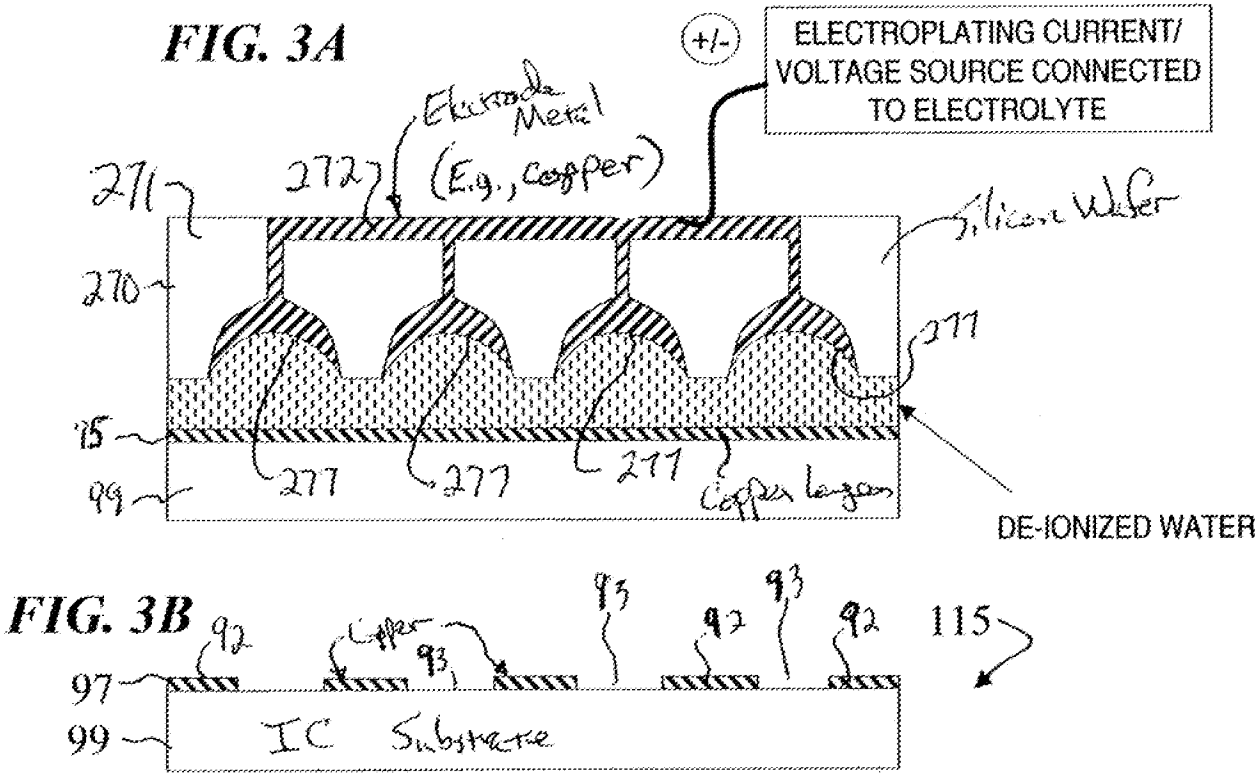
FIG. 3A is a side view of a Principle of operation D—focused-electric-field on flat or wavy surface using metal or other solid conductor electrode 270.
FIG. 3B is a side view of a substrate 99 and its resulting unplated flat surface.

FIG. 3A: Principle of operation D—focused-electric-field on flat or wavy surface using metal or other solid conductor electrode 270. In some embodiments, electrode 270 is made of a substrate of relatively non-conductive material such as intrinsic silicon, into which shaped conductors 277 have been formed using conventional lithographic techniques. In some embodiments, the shaped conductors 277 are electrically connected to one or more other conductors (e.g., either through the substrate as shown or all formed on the bottom side). These conductors and shaped conductive surfaces form one electrode (i.e., replacing electrode 110 of FIG. 1A) in a plating process that removes metal in those areas to which the shaped electrodes and the resulting shaped electric field face and are focused. In some embodiments, a plurality of areas of differing shapes is used. In some embodiments, a plurality of such shaped electrodes (i.e., either electrode 110, 270, 210, and/or 310) is used in succession, in order to remove the desired material by unplating.

Figure 3C:
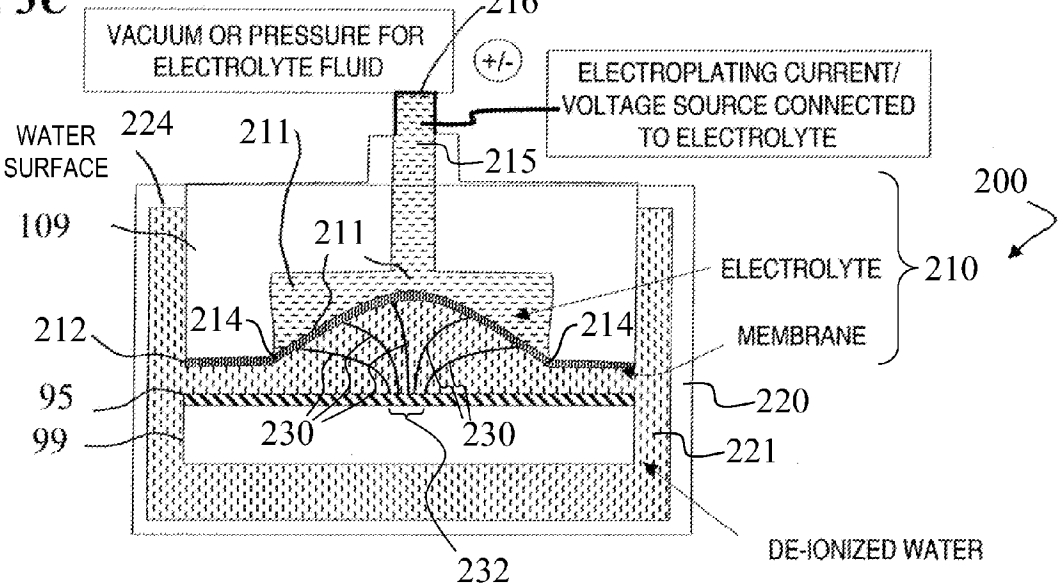
FIG. 3C is a side view of a Device for Focused Electric Field Imprinting.

In FIG. 3C, a schematic diagram of the device 120 is shown in a system 200 to demonstrate the physical principle underlying the operation of the device. This device 210 is meant for Focused Electric Field Imprinting (FEFI). The anode substrate 99 sits on the floor of a container 220 and remains submerged in de-ionized water 221. Above the substrate 99 is located the electrolytic cell 210 having a membrane surface 212 and containing an electrolyte solution (e.g., copper sulfate in water). In some embodiments for unplating, the electrolytic cell 210 is the cathode and contains an electrolyte 211. Alternatively for deposition, the electrolytic cell 210 would be the anode and contains an electrolyte 211. An opening 214 at the bottom of the cell 210 is covered with a thin flexible ion conducting membrane 212. In some embodiments, the membrane is a suitable proton-exchange membrane, such as a DuPont™ Nafion®-brand or type of membrane of suitable thickness (e.g., 200, 100, 50, 25, 10, 5, 2, 1, or other number of microns thick), e.g., such as that manufactured by and available from DuPont. In other embodiments, other suitable ion conducting membranes are used. In some embodiments, a negative gage pressure (suction) can be applied through an opening 215 at the top of the electrolytic cell (or, in other embodiments, a positive pressure is applied to the de-ionized (DI) water in a closed container 220). This applied suction 216 (or pressure differential) pulls (or pushes) the flexible membrane 212 upward and creates a membrane surface that is concave downward. The conductive electrolyte 211 distributes the cathode electric field across this curved surface, providing focusing of the field. In other embodiment, the curved electrode (277 in FIG. 3A) would provide the focused electric field across the membrane surface, onto the imprinted substrate.

When the membrane 212 remains horizontal, the electric field lines are vertical straight lines joining the membrane (cathode) 212 and the substrate (anode) 99. However, when the membrane is curved, the field lines 230 also are curved as shown in FIG. 3C. We call this crowding of the electric filed lines as the formation of a "waist" 232 in the electric field 230. When the substrate 99 is placed in this waist 232, the rate of removal of copper from the substrate (anode) 99 is much larger inside the waist compared to the areas outside the waist. This accomplishes the generation of pattern or imprinting. For a specified electric potential difference and electrolyte concentration, the size of the waist, and the intensity of the electric field within the waist is governed by membrane shape (slope and curvature), the stand-off distance as well as the shape of membrane supporting shoulder of the opening 214 on FIG. 3C.

When the electrolytic cell 210 is a vertical circular cylinder, the waist and consequently the imprinting are also circular. When the electrolytic cell is a horizontal half-circular cylinder, the waist and consequently the imprinting are long, slender rectangles. The aspect ratio of this rectangle can be different from the aspect ratio of the cylinder.

Figure 3D:
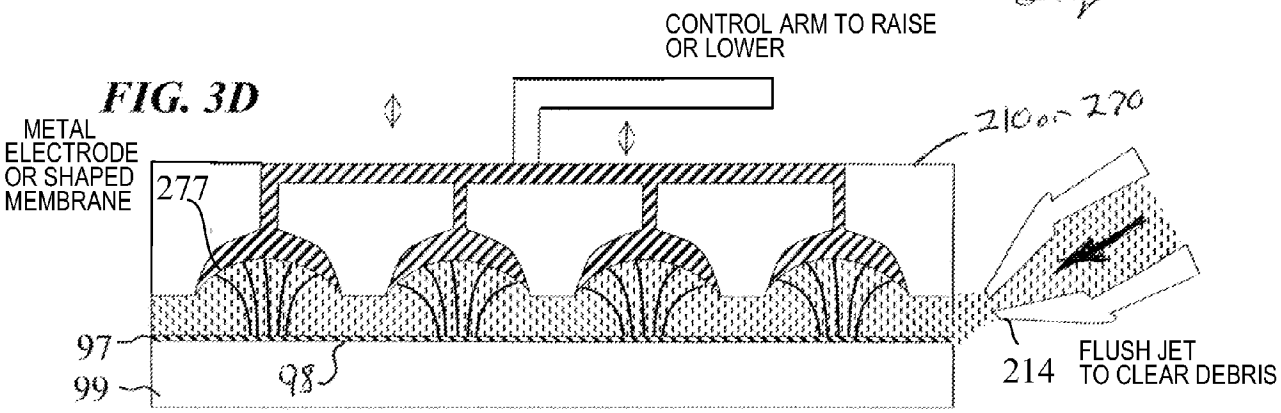
FIG. 3D is a side view of a Device for Flushing debris from the operation that uses Focused Electric Field Imprinting.

FIG. 3D is a side view of a device 280 for flushing debris from the operation that uses focused electric field imprinting. In some embodiments, a control arm periodically raises electrode 210 or 270 to help remove debris. In some embodiments, (whether or not the electrode is raised) a flushing jet 278 squirts fluid (e.g., DI water) between the electrode 210/270 and the workpiece 99 to help remove any debris.

Figure 3E:
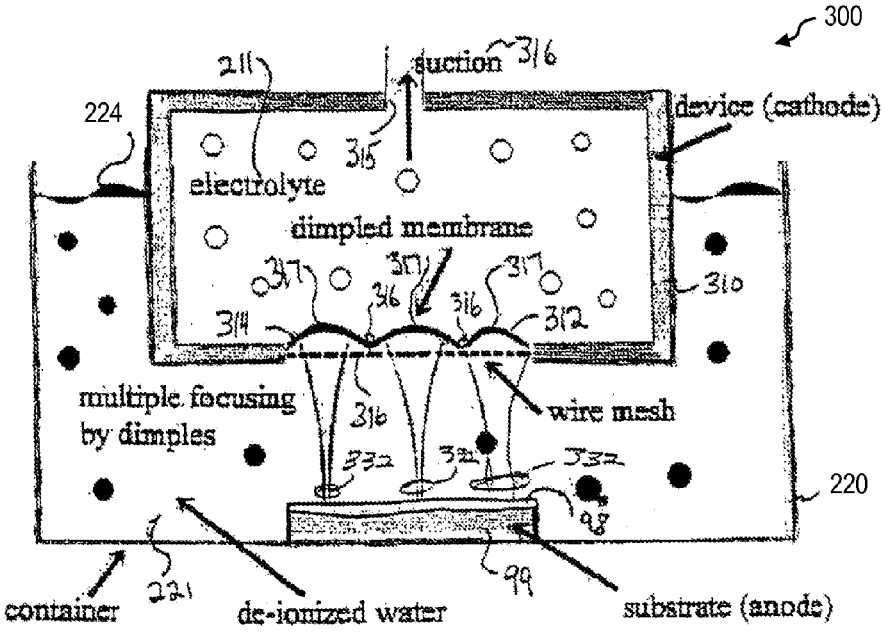
FIG. 3E is a side view of a Device for FEFI parallel processing.

In FIG. 3E, an alternative embodiment device 310 (a modification of the device 210) is shown. This modification enables the device 310 to produce multiple patterns simultaneously (using parallel processing). In this modified device 310, we put a mask made of either weaved wire mesh or perforated sheet 316 across the opening 314 at the bottom of the electrolytic cell 310. The membrane 312 is located below the wire mesh 316. When the suction or pressure differential is applied, the membrane 316 is pulled/pushed upward through the openings in the wire mesh 316. This produces an array of dimples in the membrane (e.g., rectangular array of dimples for a rectangular wire mesh). Each of these dimples 317 is concave downward and each dimple 317 produces its own waist 332 in the electric field. Therefore, for an array of dimples 317, an array of waists 332 is produced, and an array of holes is formed (i.e., unplated) in the copper layer 98. When the substrate 99 is placed in this array of waists 332, an array of patterned holes or openings is produced in the copper layer 98.

In some embodiments, the mask could be an electrically conductive material and act as the electrode. In other embodiments, the mask could be an electrically nonconductive material and an electrode has to be inserted into the electrolyte cavity 211. In yet another embodiment, the mask could be made of an electrical semiconductor material. In some embodiments of such a scenario, a pulsed DC voltage is used.

In some embodiments, rather than a mask of weaved wire mesh or perforated sheet, a membrane-support substrate 336 having deep-etched grooves or holes is used to support the membrane 312. When the electrolytic cell 310 includes a support substrate 337 (see FIG. 3) having vertical circular cylinder holes 338, the waist and consequently the imprinting are also an array of circles. When the electrolytic cell includes a substrate 337 having horizontal grooves or openings, the waists and consequently the imprinting are several (possibly perpendicular or parallel), long, slender (possibly rectangular) openings in the copper layer. By using different etched membrane-support substrates 337 or 336 (as shown in FIGS.

3B and 3E) (or different masks of weaved wire or perforated holes 316 with different number of openings per unit area), one can control the number of circles or the number of lines the imprinting will produce. In other embodiments, processes other than etching can be used to form similar membrane-support substrates.

Figure 3F:
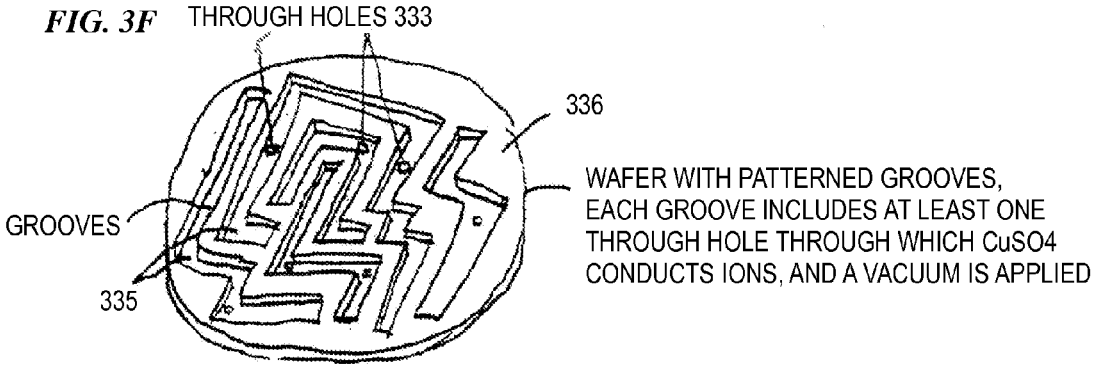
FIG. 3F is a perspective view of a grooved substrate 336 having a plurality of deep-etched grooves 335.

FIG. 3F shows a perspective view of a grooved membrane-support substrate 336 having a plurality of deep-etched grooves 335. In some embodiments, each groove is etched completely through the substrate 336 (e.g., a silicon wafer, in some embodiments). In other embodiments, each groove is etched partially through, and each groove 335 has one or more through holes 333 etched completely through. These holes provide paths through which electrolyte solution (e.g., copper sulfate in water) can be introduced and through which vacuum or pressure can be applied to shape and/or curve the membrane 312 applied to its lower surface (the upper surface in this FIG. 3B is the lower surface in FIG. 3C). Grooves 335 can be etched using any suitable semiconductor process such as DRIE (deep reactive ion etching) to achieve the desired size, orientation, depth and pattern to be used to shape the membrane to be stretched across the substrate 336. The through-holes 333 are used to apply a vacuum to the membrane, and to introduce electrolyte solution to the back of the membrane. In some embodiments, ultrasound or other techniques are used to remove bubbles. In other embodiments, the entire device 301 (see FIG. 3C) is inserted into a vacuum to remove air from both sides of the membrane, and then electrolyte solution is slowly introduced into the grooves 335 through holes 333 while equalizing pressure on the membrane, in order that there are no air bubbles in the electrolyte in the cell.

Figure 3G:
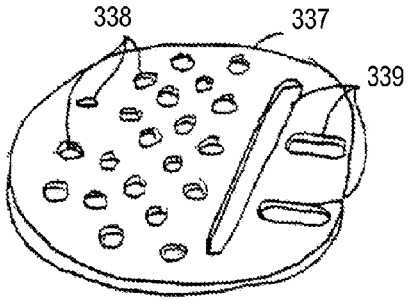
FIG. 3G is a perspective view of a grooved and via-ed substrate 337. Substrate 337 can be substituted for substrate 336 in some embodiments of FIG. 3C.
Figures 3H, 3I:
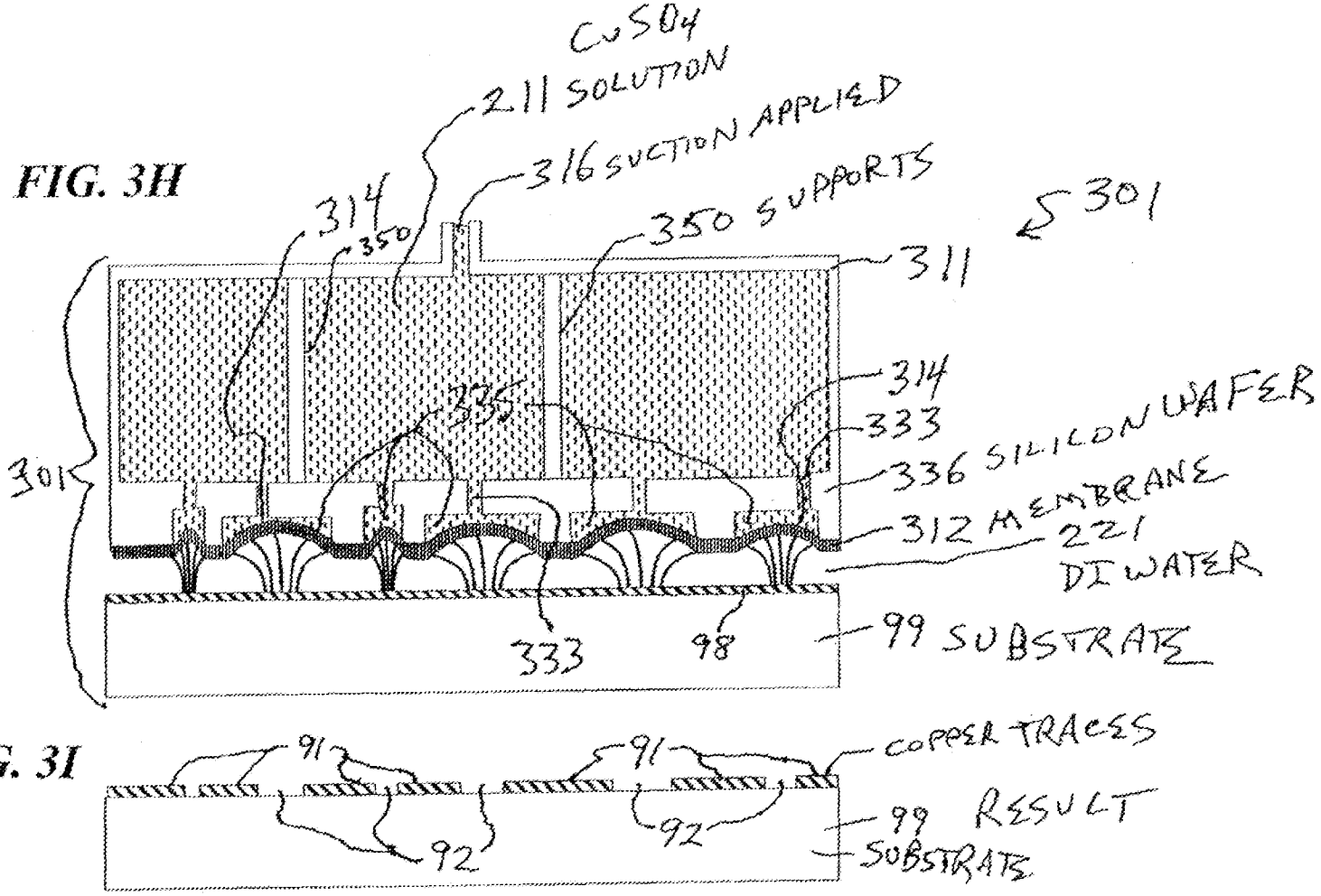
FIG. 3H is a cross section schematic drawing of a system 301 for removing patterns of selected portions 92 of copper layer 98 from substrate 99.
FIG. 3*i* is a cross-section view of the resulting substrate 99 having copper patterns or traces 91 remaining.

FIG. 3H shows a cross section schematic drawing of a system 301 for removing patterns of selected portions 92 of copper layer 98 from substrate 99. When a pressure differential is applied to membrane 312, curved patterns 314 appear due to grooves 335. The electrolyte solution 211 applies a curved electric field on the upper side of the curved sections 314 of membrane 312, and the waists of the electric field in the DI water 221 selectively and preferentially remove patterns of copper layer 98 through non-contact electrolytic unplating of the copper. In some embodiments, the removed copper ions pass through membrane 312 into the electrolyte solution 211. In some embodiments, a plurality of supports 350 are provided between housing 311 and grooved substrate 336 (or stiffening ribs are attached to the back of substrate 336), to keep the substrate from breaking due to the applied vacuum or pressure differential.

FIG. 3G is a perspective view of a grooved and via-ed substrate 337. Substrate 337 can be substituted for substrate 336 in some embodiments of FIG. 3C. In some embodiments, substrate 337 has a plurality of cylindrical vias 338 etched through the substrate 337, and/or a plurality of through-etched grooves 339, through which electrolyte solution (e.g., copper sulfate in water) can be introduced and through which vacuum or pressure can be applied to shape and/or curve the membrane 312 applied to its lower surface (the upper surface in this FIG. 3E is the lower surface in FIG. 3C). Grooves 339 and vias 338 are formed to any suitable shape and size, and can be etched using any suitable semiconductor process, such as DRIE (deep ion reactive etching) to achieve the desired size, orientation, depth and pattern to be used to shape the membrane to be stretched across the substrate 337. The through-holes 338 and 339 are used to apply a vacuum to the membrane 312, and to introduce electrolyte solution 211 to the back (inner surface) of the membrane 312. In some embodiments, ultrasound or other techniques are used to remove bubbles. In other embodiments, the entire device 301 (see FIG. 3C) is inserted into a vacuum to remove air from both sides of the membrane, and then electrolyte solution is slowly introduced into the through-holes 338 and 339 while equalizing pressure on the membrane 312, in order that there are no air bubbles in the electrolyte in the cell.

In some embodiments, the present invention does not use a separate proton-exchange membrane, but simply uses an electrode formed by micro-machining or nano-machining a substrate into a desired electrode shape having flat, convex, and/or concave shapes on its surface. The formed electrode can be used by itself if the substrate can be immersed in the electrolyte solution. Another embodiment is to spin coat the ion conducting layer 312 directly onto the machined electrode 336 in FIG. 3C.

FIG. 3*i* shows a cross-section view of the resulting substrate 99 having copper patterns or traces 91 remaining and openings or holes 92 where the copper was removed by the present invention.

Figure 4A:
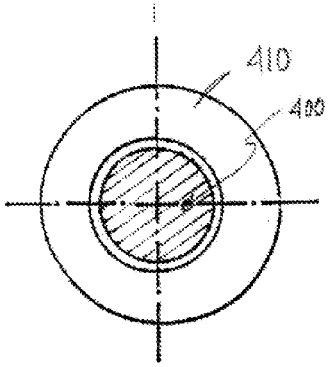
FIGS. 4A-4C are schematic views of a system 400 for patterning on a curved surface.
Figure 4B:
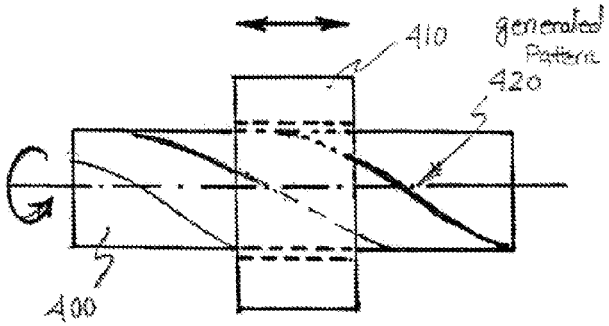
Figure 4C:
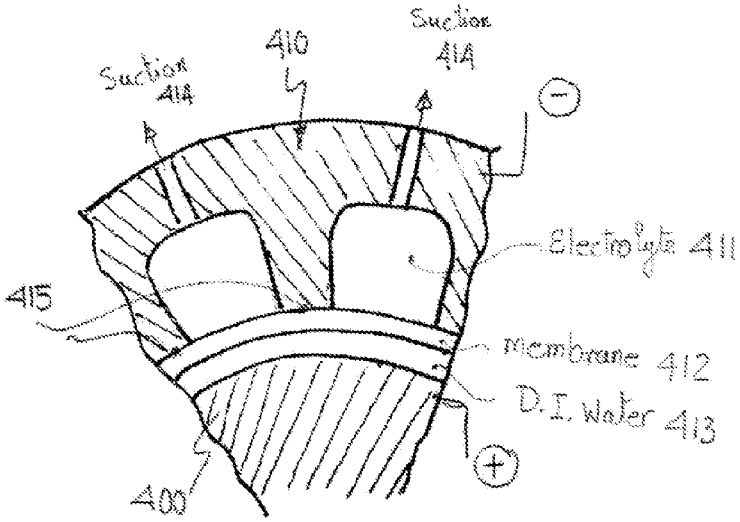

In FIGS. 4A and 4B, another principle of operation of device 410 is shown. The system can imprint patterns 420 on the circumference of a workpiece 400, along any path that can be developed by combining relative axial and rotational motion between the device 410 and the workpiece 400. The rotation need not be about a fixed axis. The cross-section of the device 410 and the workpiece 400 need not be circular. The relative speed is in the range of microns/sec. FIG. 4C shows detailed cross-section of the device 410 at its contact with the workpiece 400. The device head 410 has series of electrolyte filled internal cavities 411. These cavities can form a single electrode, or can be wired independently for sequential or parallel activation. An ion conducting membrane 412 is covering these cavities and is supported to the device 410 at connecting points 415. A layer of DI water 413 is maintained between the workpiece 400 and the device 410. Each electrolyte cavity 411 has a suction port 414 to control the differential pressure and the local curvature of the attached membrane 412. The suction ports could be independently controlled to form specially varying pattern along the imprinted profile.

In some such embodiments, the invention uses a periodic flush to remove any debris that is produced by the unplating process. In some embodiments, the debris is sucked up through the membrane into the $CuSO_4$ solution in the electrolytic cell, and this solution is replaced periodically. Thus, a scratch-free, clean surface is provided on the electrode and the device being unplated.

In all embodiments, the applied DC voltage should be high enough such that the kinetics of the electrode reactions is not limiting the rate of the faradic process. In other embodiment, a chopped DC voltage is utilized to improve the material removal rate. The chopping rate should be of the same order of the electric boundary layer build up at the anode interface.

Figure 5A:
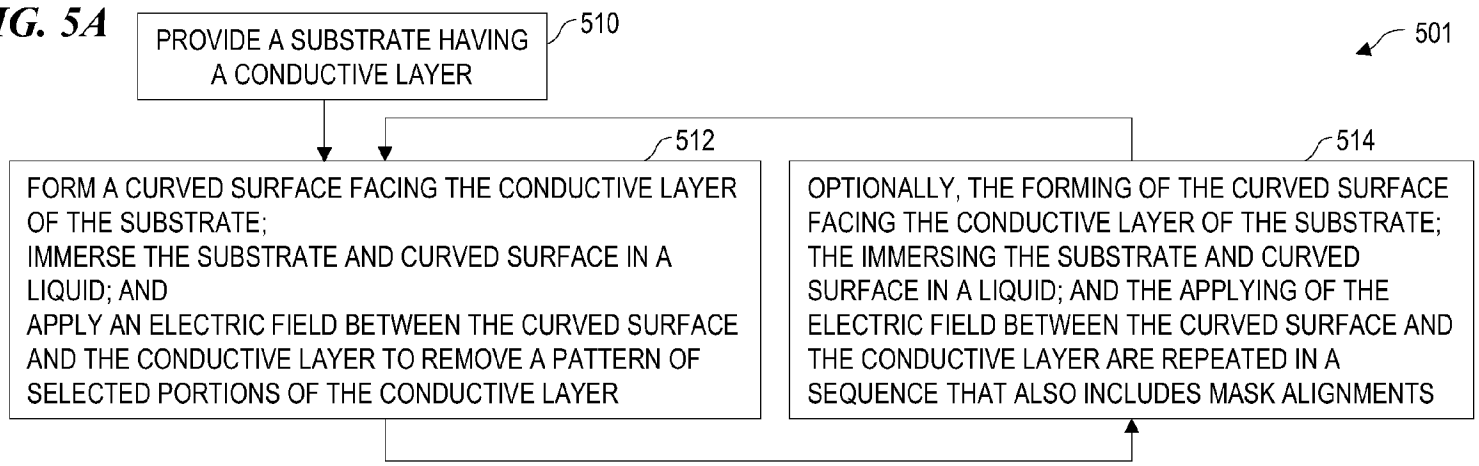
FIG. 5A is a flowchart 501 of an embodiment that provides optional iterative mask alignment.

FIG. 5A is a flowchart 501 of an embodiment that provides optional iterative mask alignment. In some embodiments, flowchart 501 is of a method comprising: providing a substrate having a conductive layer (block 511); forming a convex compliant surface facing the conductive layer of the substrate; immersing the substrate and convex compliant surface in a liquid; and applying an electric field between the convex surface and the conductive layer to remove a pattern of selected portions of the conductive layer (block 512). In some embodiments, the method is used for patterning conductor surfaces. In some embodiments, the method is used to both planarize (using a convex membrane) and patternize (using a concave membrane). In some embodiments, the method further includes using weaved wire mesh or perforated mask behind the membrane in order to perform the method in a parallelized manner. In some embodiments, the method further includes suitably curving the membrane and adjusting its stand-off distance, in order that the image of the mask is reduced. In some embodiments (as shown in block 514), the forming of the convex surface facing the conductive layer of the substrate; the immersing the substrate and convex compliant surface in a liquid; and the applying of the electric field between the convex surface and the conductive layer are repeated in a sequence that also includes mask alignments, in order to produce sub-100-nm lines with sub-100-nm spacing. In some embodiments, the providing of the substrate includes providing a substrate having a surface with a surface roughness of at least about 100 times a wavelength of visible light. In some embodiments, the providing of the substrate includes providing a substrate having a wavy surface with a surface waviness of at least about 100 times a wavelength of visible light in order to imprint on the wavy surface, wherein the substrate is suitable for flexible electronics circuits.

Figure 5B:
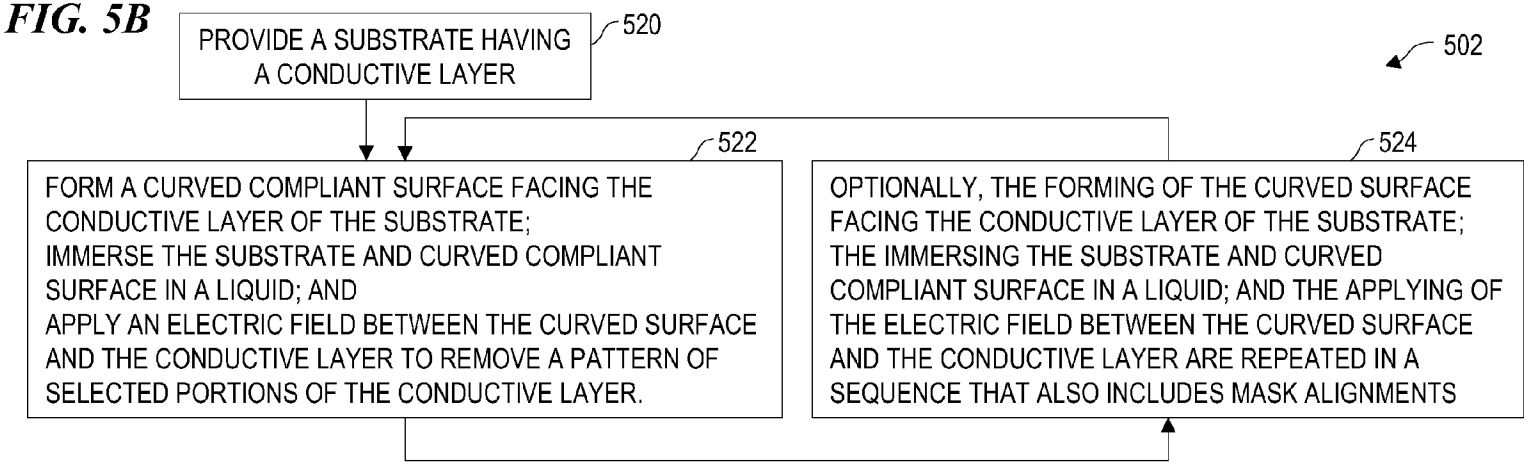
FIG. 5B is a flowchart 502 of an embodiment that provides optional iterative mask alignment.

FIG. 5B is a flowchart for a machine 502 of an apparatus embodiment that provides optional iterative mask alignment. In some embodiments, the apparatus includes a machine for processing a substrate (see block 520) having a conductive layer, wherein the machine 502 includes a membrane having at least one convex or concave surface area that is placed facing the conductive layer of the substrate; a station 522 that immerses the substrate and membrane in a liquid; and a source of electrical power that is connected to apply an electric field between the membrane and the conductive layer to remove a pattern of selected portions of the conductive layer. In some embodiments, the substrate once processed includes a pattern of conductors on a surface of the substrate. In some embodiments, wherein the membrane also includes at least one concave area, such that the substrate is both planarized (using the at least one convex membrane portion) and patternized (using the at least one concave membrane portion). Some embodiments further include a wire mesh or mask behind the membrane in order for the machine to operate in a parallel manner. In some embodiments, the membrane is suitably curved and adjusted in its stand-off distance, in order that the image features of the mask are reduced. In some embodiments, the immersion station is repeatedly used in an iterative sequence that also includes mask alignments, in order to produce sub-100-nm lines with sub-100-nm spacing. In some embodiments, the substrate has a surface roughness of at least about 100 times a wavelength of visible light. In some embodiments, the substrate has a wavy surface with a surface waviness of at least about 100 times a wavelength of visible light used to imprint on the wavy surface, wherein the substrate is suitable for flexible electronics circuits.

Example for FEFI Device

Using an apparatus equivalent to that shown in and described with reference to FIG. 3A, parallel micro-pattern imprinting was successfully accomplished. The apparatus used was configured with masks of weaved wire mesh or perforated sheets and Nafion membrane of thickness (12.5, 25, 50 μm). A range of array of patterns and 2D features were produce on both electro-plated copper films on a substrate and polished bulk copper substrate with dimensions of 20-2000 microns in width and 0.1-10 microns in depth. The geometric features, uniformity and aspect ratio of each pattern depends on the utilized current density (1-10 $mA/mm^2$), exposure time (15-150 s) and stand off distance (10-100 μm). A range of suction pressure was applied on the electrode cavity ranging from 0.5-15 in-Hg (i.e., about 1.27 to 38 cm mercury). In some embodiments, a typical copper electrolyte for faradic process is used (e.g., 0.25 mol/L of $CuSO_4.5H_2O$ and 1.8 mol/L $H_2SO_4$).

The FEFI Experiment

Special care is necessary, in some embodiments, for controlling the exact distance between the device (cathode) and the substrate (anode). Another requirement, in some embodiments, is that the device and the substrate should be parallel. In some embodiments, to ensure such accuracy, motorized actuators are used.

In some embodiments, the present invention provides a Focused Electric Field Imprinting (FEFI) method that includes electrolytically transporting (i.e., removing or depositing) selected portions of a metal layer wherein an electric field is focused by a concave curvature surface or a convex curvature surface of a proton-exchange membrane, or by a curved electrode behind the membrane.

In other embodiments, the present invention provides a second method that includes providing a substrate having a conductive layer; forming a concave surface facing the conductive layer of the substrate; immersing the substrate and concave surface in a liquid; and applying an electric field between the concave surface and the conductive layer to remove selected portions of the conductive layer.

In some embodiments of the second method, the liquid is de-ionized water located between the conductive surface and the concave surface.

In some embodiments of the second method, the forming of the concave surface includes applying a pressure differential across a constrained membrane.

In some embodiments of the second method, the conductive surface includes copper or other electrically conductive substrates, the method further comprising applying an electrolyte solution (copper sulfate solution in the case of copper substrate) to a surface of the ion conducting membrane distal to the conductive substrate. In some embodiments, the membrane conducts copper ions through it.

In yet other embodiments, the present invention provides a third method that includes providing a substrate having a conductive layer; forming a convex surface facing the conductive layer of the substrate; immersing the substrate and convex compliant surface in a liquid; and applying an electric field between the convex surface and the conductive layer to remove a pattern of selected portions of the conductive layer.

In some embodiments of the third method, the third method is used for patterning conductor surfaces.

In some embodiments of the third method, the method is used to both planarize (using a convex membrane) and patternize (using a concave membrane).

Some embodiments of the third method further include using a weaved wire mesh or perforated mask behind the membrane in order to perform the method in a parallelized manner.

In some embodiments of the third method, the method further includes suitably curving the membrane and adjusting its stand-off distance, in order that the image of the mask is reduced.

In some embodiments of the third method, 20-2000-micron images with 0.1-10-micron depth are produced. In various embodiments, the present invention produces devices having features (i.e., as images on the devices) with lateral dimensions of about 200 microns or less, of about 150 microns or less, of about 125 microns or less, of about 100 microns or less, of about 90 microns or less, of about 80 microns or less, of about 70 microns or less, of about 60 microns or less, of about 50 microns or less, of about 40 microns or less, of about 30 microns or less, of about 20 microns or less, of about 15 microns or less, of about 12.5 microns or less, of about 10 microns or less, of about 9 microns or less, of about 8 microns or less, of about 7 microns or less, of about 6 microns or less, of about 5 microns or less, of about 4 microns or less, of about 3 microns or less, of about 2 microns or less, of about 1.5 microns or less, of about 1.25 microns or less, of about 1 microns or less, or of about 0.5 microns or less. In combination with any of the above, various embodiments of the present invention provide or produce devices having features (i.e., as images on the devices) with depth dimensions of about 50% of the minimum lateral dimensions, depth dimensions of about 40% of the minimum lateral dimensions, depth dimensions of about 30% of the minimum lateral dimensions, depth dimensions of about 20% of the minimum lateral dimensions, depth dimensions of about 10% of the minimum lateral dimensions, depth dimensions of about 5% of the minimum lateral dimensions, depth dimensions of about 3% of the minimum lateral dimensions, depth dimensions of about 2% of the minimum lateral dimensions, or depth dimensions of about 1% of the minimum lateral dimensions.

In some embodiments of the third method, sub-100 nm lines with about 5 micron pitch are possible to be produced using a single setting.

In some embodiments of the third method, the forming of the convex surface facing the conductive layer of the substrate; the immersing the substrate and convex compliant surface in a liquid; and the applying of the electric field between the convex surface and the conductive layer are repeated in a sequence that also includes mask alignments, in order to produce sub-100-nm lines with sub-100-nm spacing.

In some embodiments of the third method, the providing of the substrate includes providing a substrate having a surface with a surface roughness of at least about 100 times a wavelength of visible light.

In some embodiments of the third method, the providing of the substrate includes providing a substrate having a wavy surface with a surface waviness of at least about one hundred times a wavelength of visible light in order to imprint on the wavy surface, wherein the substrate is suitable for flexible electronics circuits.

In some embodiments, FEFI is a low-cost alternative to the current lithographic techniques used in Integrated Circuit manufacturing. Compared to Deep Ultraviolet (DUV) lithography tools, FEFI will significantly contribute to the cost reduction in VLSI/ULSI fabrication.

1 Rajukar, K. P., Levy, G., Malshe, A., Sundaram, M. M., McGeough, J., DeSilva, A., Hu, X., Resnick, R.. "Micro and nano Machining by Electro-Physical and Chemical Processes". *Annals of the CIRP,* 55/2, pp. 1-24, (2006)

2. R. E. Miller, P. Bischoff, R. Summer, S. Bowler, W. W. Flack, and G. Fong, "The Development of 157 nm Small Field and Mid-Field MicroSteppers", SPIE 2000 #4000-174, Ultratech Stepper, Inc., San Jose, Calif. 95134 (2000).

3 Liu. B.; H. Jiang, H. T. Johnson, and Y. Huang, "The influence of mechanical deformation on the electrical properties of single wall carbon nanotubes," Journal of the Mechanics and Physics of Solids, 52, 1-26, (2004)

4 IWF, IPT, Investigation of the International State of the Art of Micro Production and Technology, MickroPRO, (2002)

5 McGeough, J. A. London, A., Principles of Electrochemical Machining, Chapman and Hall; New York, distributed in the U.S.A. by Halsted Press, (1974)

6 Friedrich, C.R., Warrington, R., W. Bacher, et al., in: P. Rai-Choudhury (Ed.), *Handbook of Microlithography, Micromachining, and Microfabrication,* vol. 2, SPIE, Bellingham. Wash., p. 299, (1997)

7 Dunkel, K. Bauer, H.-D., Ehrfeld, W., et al., "Injection-molded fiber ribbon connectors for parallel optical links fabricated by the LIGA technique," J. Micromech. Microeng., 8, 301, (1998)

8 Craston, D. H., Lin, C. W., Bard, A. J., "High Resolution Deposition of Silver in Nafion films with the Scanning Tunneling Microscope," Journal of the Electrochemical Society, 135(3), p. 785-786, (1988)

9 Husser, O. E., Craston, D. H., Bard, A. J., "Scanning Electrochemical Microscopy," Journal of the Electrochemical Society, 136(11), p 3222-3229, (1989)

10 Andricacos, P.C., "Copper on Chip Interconnections, A Breakthrough in Electrodeposition to make better Chips," Electrochem. Soc. Interf., 8, 32, (1999)

11 Steigerwald, J., Murarka, S., and Gutmann, R., Chemical *Mechanical Planarization of Microelectronic Materials*, John Wiley & Sons Pub., New York, (1997)

12 Huo, J., Solanki, R., and McAndrew, J. "Electrochemical Planarization of Patterned Copper Films for Microelectronics Applications," J. of Materials Engineering and Performance, 13 (14), pp. 413-420, (2004)

13 Wilson, J. F., *Practice and Theory of Electrochemical Machining*, Wiley-Interscience, A division of John Wiley & Sons Inc., London, New York, (1971)

14 Mazur, S., C. E. Jackson, and G. W. Foggin, "Membrane-Mediated Electropolishing of Damascene Copper," IEEE international Interconnect Technology Conference (2005)

What is claimed is:

1. An apparatus for focused-electric-field imprinting (FEFI) a pattern on a curved surface of a workpiece, the apparatus comprising:

a patterned device head having a major curved surface that conforms to the curved surface of the workpiece, wherein the device head's major curved surface has a plurality of recesses separated by raised areas and one or more passageways connected to the plurality of recesses, wherein the apparatus holds an electrolyte in the passageways and recesses of the device head;

a relative axial and rotational motion unit operatively coupled to move the device head and the workpiece relative to one another in an axial direction and a rotational direction; and an electrical circuit operatively coupled to the device head and configured to electrolytically transport selected portions of a metal layer on the workpiece using an electric current passing through the electrolyte.

2. The apparatus of claim 1, wherein the device head includes an ion-conducting membrane supported by edges of the recesses to provide a curved membrane surface configured to focus an electric field of the electric current using the curved membrane surface, in order to guide the electrolytic transport.

3. The apparatus of claim 1, wherein the device head includes an ion-conducting membrane supported by edges of the recesses to provide a curved membrane surface configured to focus an electric field of the electric current using the curved membrane surface, wherein the electrolytic transport of the selected portions of the metal layer on the workpiece is assisted by the electric current through the membrane.

4. The apparatus of claim 1, wherein the major curved surface of the device head comprises a membrane-support surface having the raised areas between the recesses, wherein the plurality of recesses in the major curved surface of the device head are covered with ion-conducting membrane that is constrained against the raised areas of the membrane-support surface;

a pressure-differential controller operatively coupled to the electrolyte in the passageways to curve a surface of the membrane, wherein the electrolytic transport of the selected portions of the metal layer on the workpiece is assisted by the electric current through the membrane.

5. The apparatus of claim 1, wherein the apparatus deposits metal onto the metal layer on the substrate.

6. The apparatus of claim 1, wherein the apparatus removes metal from the metal layer on the substrate.

7. The apparatus of claim 1, wherein the workpiece has a cylindrical outer surface, wherein the device head has a cylindrical inner surface, and wherein the relative axial and rotational motion unit moves the workpiece in an axial direction along the workpiece's longitudinal axis and rotates the workpiece in a rotational direction around the workpiece's longitudinal axis.

8. An apparatus for focused-electric-field imprinting (FEFI) a pattern on a curved surface of a workpiece, the apparatus comprising:

a patterned device head having a major curved surface that conforms to the curved surface of the workpiece, wherein the device head's major curved surface has a plurality of recesses separated by raised areas and one or more passageways connected to the plurality of recesses, and wherein the apparatus holds an electrolyte in the passageways and recesses of the device head;

means for moving the device head and the workpiece relative to one another in an axial direction and a rotational direction; and means for electrolytically transporting selected portions of a metal layer of the workpiece.

9. The apparatus of claim 8, further comprising:

means for covering the plurality of recesses of the device head with an ion-conducting curved surface in contact with the electrolyte; and means for focussing an electric field of the electric current using the curved surface of the means for covering, in order to guide the transporting, wherein the workpiece has a convex cylindrical outer surface, wherein the device head has a concave cylindrical inner surface, and wherein the moving of the device head and the workpiece relative to one another includes moving the workpiece in an axial direction along the workpiece's longitudinal axis and rotating the workpiece in a rotational direction around the workpiece's longitudinal axis.

10. The apparatus of claim 8, further comprising:

means for covering the plurality of recesses in the major curved surface of the device head, wherein the means for electrolytically transporting of the selected portions of the metal layer on the workpiece includes means for passing the electric current through the means for covering.

11. The apparatus of claim 8, wherein the major curved surface of the device head comprises a membrane-support surface having the raised areas between the recesses, the apparatus further comprising:

ion-conducting membrane material covering the plurality of recesses in the major curved surface of the device head, means for constraining the membrane material against the raised areas of the membrane-support surface and for curving the membrane material relative to edges of the recesses; and means for applying controlled pressure to the electrolyte in the passageways to curve a surface of the membrane, wherein the electrolytically transporting of the selected portions of the metal layer on the workpiece includes passing the electric current through the membrane.

12. The apparatus of claim 8, wherein the means for transporting includes means for depositing metal onto the metal layer on the substrate.

13. The apparatus of claim 8, wherein the means for transporting includes means for removing metal from the metal layer on the substrate.

14. An apparatus for focused-electric-field imprinting (FEFI) a pattern on a surface of a workpiece, the apparatus comprising:

a patterned tool head having a major surface that conforms to the surface of the workpiece, wherein the tool head's major surface has a plurality of concave recesses separated by raised areas, wherein the shape of the concave recesses acts to shape an electric field associated with the FEFI, and wherein the apparatus holds an electrolyte in the recesses of the tool head;

a relative motion unit operatively coupled to move the tool head and the workpiece relative to one another; and an electrical circuit operatively coupled to the tool head and configured to electrolytically transport selected portions of a metal layer on the workpiece using an electric current passing through the electrolyte.

15. The apparatus of claim 14, wherein the major surface is curved.

16. The apparatus of claim 14, wherein the plurality of recesses are coupled to at least one passageway for conducting the electrolyte.

17. The apparatus of claim 14, wherein the relative motion unit provides relative movement between the tool head and the workpiece in a pattern of rotational and axial directions.

18. The apparatus of claim 14, further comprising a flush jet to clear debris.

19. The apparatus of claim 14, wherein the tool head performs a plating operation.

20. The apparatus of claim 14, wherein the tool head performs an unplating operation.

* * * * *